US010770249B2

(12) United States Patent
Gentsch

(10) Patent No.: US 10,770,249 B2
(45) Date of Patent: Sep. 8, 2020

(54) POLE PART FOR A LOW-, MEDIUM OR HIGH VOLTAGE CIRCUIT BREAKER, AND METHOD FOR MANUFACTURING THE SAME

(71) Applicant: ABB Schweiz AG, Baden (CH)

(72) Inventor: Dietmar Gentsch, Ratingen (DE)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 16/255,911

(22) Filed: Jan. 24, 2019

(65) Prior Publication Data

US 2019/0157029 A1 May 23, 2019

Related U.S. Application Data

(63) Continuation of application No. PCT/EP2017/069028, filed on Jul. 27, 2017.

(30) Foreign Application Priority Data

Jul. 27, 2016 (EP) ..... 16181397

(51) Int. Cl.
*H01H 33/42* (2006.01)
*H01H 33/662* (2006.01)

(52) U.S. Cl.
CPC ..... *H01H 33/66207* (2013.01); *H01H 33/42* (2013.01); *H01H 2033/6623* (2013.01); *H01H 2209/002* (2013.01); *H01H 2209/012* (2013.01)

(58) Field of Classification Search
CPC ..... H01H 33/66207; H01H 2033/6623; H01H 33/662; H01H 11/00; H01H 33/42; H02B 13/0354
USPC ..... 218/139, 134, 138, 155; 335/201
See application file for complete search history.

(56) References Cited

U.S. PATENT DOCUMENTS 5,597,992 A * 1/1997 Walker ..... H01H 33/6606 218/121
6,130,394 A * 10/2000 Hogl ..... H01H 33/66207 218/138
8,674,254 B2 * 3/2014 Borgstrom ..... H01H 33/42 218/136
8,785,802 B2 * 7/2014 Shang ..... H01H 33/66207 218/120
2006/0011589 A1 * 1/2006 Hering ..... H01H 33/66207 218/118
2008/0087647 A1 4/2008 Volkmar
2008/0142485 A1 6/2008 Gentsch et al.
2016/0126037 A1 * 5/2016 Gerovac ..... H01H 33/6606 218/139

(Continued)

FOREIGN PATENT DOCUMENTS

CN 101038827 A 9/2007
DE 19921477 A1 11/2000

(Continued)

*Primary Examiner* — Edwin A. Leon
*Assistant Examiner* — William A Bolton
(74) *Attorney, Agent, or Firm* — Leydig, Voit & Mayer, Ltd.

(57) ABSTRACT

A pole part for a medium or high voltage circuit breaker includes: an insert in an insulating housing; and a compensation layer between the insert and the insulating housing. The compensation layer includes a potting material on an epoxy or polyurethane basis, with a shore hardness of 12 to 90 shore A.

11 Claims, 1 Drawing Sheet

(56) References Cited

U.S. PATENT DOCUMENTS

2017/0207039 A1* 7/2017 Pohle ..... H01H 11/00

FOREIGN PATENT DOCUMENTS

| | | | |
|---|---|---|---|
| EP | 2706549 | A1 | 3/2014 |
| WO | WO 0041199 | A1 | 7/2000 |

* cited by examiner

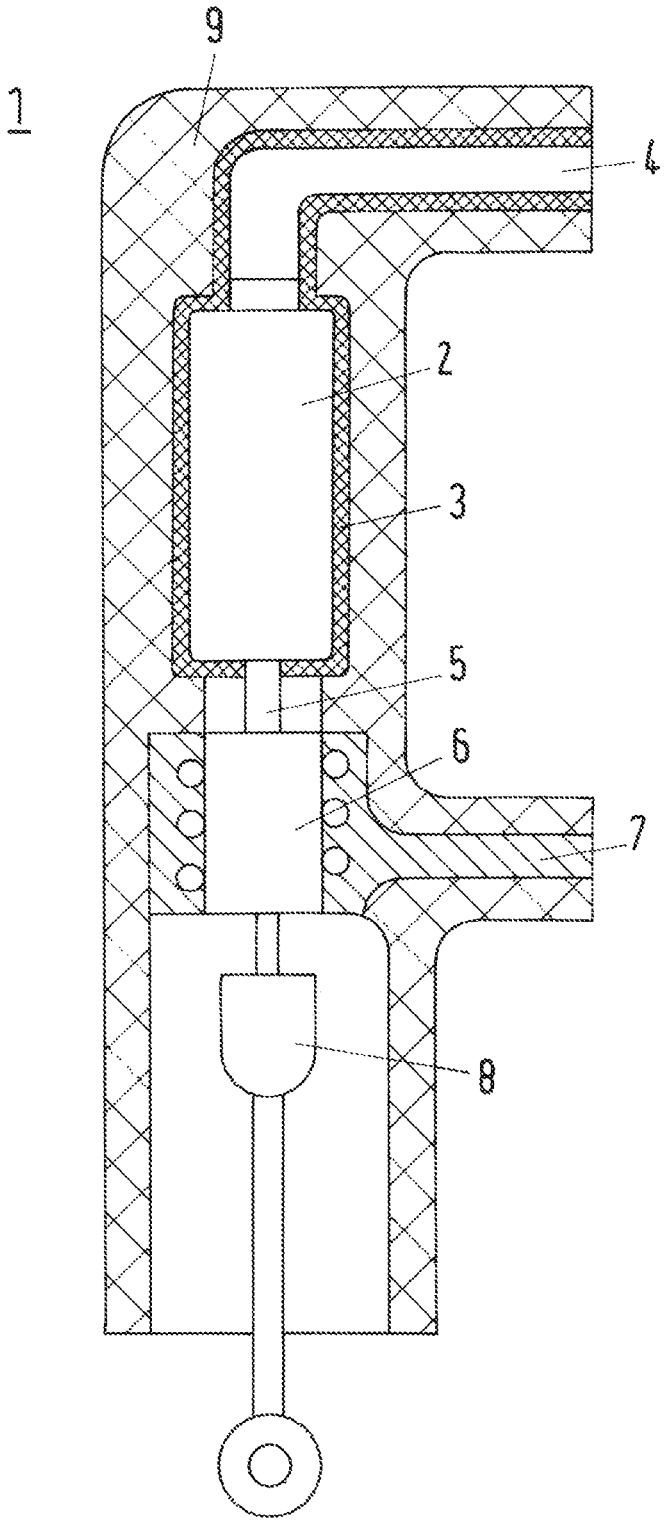
9
1
4
2
3
5
6
7
8

POLE PART FOR A LOW-, MEDIUM OR HIGH VOLTAGE CIRCUIT BREAKER, AND METHOD FOR MANUFACTURING THE SAME

CROSS-REFERENCE TO PRIOR APPLICATION

This application is a continuation of International Patent Application No. PCT/EP2017/069028, filed on Jul. 27, 2017, which claims priority to European Patent Application No. EP 16181397.7, filed on Jul. 27, 2016. The entire disclosure of both applications is hereby incorporated by reference herein.

FIELD

The invention relates to a pole part for a low-, medium- or high voltage circuit breaker, with an insert in an insulating housing, and method for manufacturing the same.

BACKGROUND

In production of an epoxy or another embedded pole part by using the direct embedding technology, there it is necessary to use a compensation layer at the insert, in order to reduce the mechanical stress inside the part after the production process.

Actually the mechanical and residual stress of the material after the embedding process is compensated by the use of a warm shrinkage tube or by the use of silicone material at first at the insert part.

For the shrinkage tube there is a heat shrinkage device necessary and a well adapted process to get a tight connection between the shrinkage tube and the insert part.

Furthermore the insert has to be cylindrical because the shrinkage tube can cover these parts with some steps in between. In case of the silicon rubber use, there is more flexibility to cover the insert part, here can be used a more intrinsic part, for example a group assembly inside the embedded pole part.

The disadvantage of the silicone layer there is needed to get primer at first to the insert part to the silicone layer and after the process there is need to clean the silicone from the silicone-oil and to primer again to get good wetting to the epoxy material.

SUMMARY

In an embodiment, the present invention provides a pole part for a medium or high voltage circuit breaker, comprising: an insert in an insulating housing; and a compensation layer between the insert and the insulating housing, wherein the compensation layer comprises a potting material on an epoxy or polyurethane basis, with a shore hardness of 12 to 90 shore A.

BRIEF DESCRIPTION OF THE DRAWINGS

The present invention will be described in even greater detail below based on the exemplary FIGURES. The invention is not limited to the exemplary embodiments. Other features and advantages of various embodiments of the present invention will become apparent by reading the following detailed description with reference to the attached drawings which illustrate the following:

FIG. 1 shows a longitudinal cut of a pole part 1.

DETAILED DESCRIPTION

It is an object of the invention, to enhance the dielectric performance, as well as the effectivity of manufacturing steps with high reproductivity.

With that, the invention is, that the compensation layer consist of a potting material on epoxy basis, with a shore hardness of 12 to 90 shore A.

By that, this new suggestion is to use a thin layer of a potting material, based on epoxy, or polyurethane material, with a shore hardness similar or less than the actual warm shrinkage tube.

In case of the use of that type of potting material, there is no need of the use of a primer application to the insert part, nor the need of primer to the epoxy resin as used today. The dielectric strength of the material can be covered and is similar to the actual solution. In case of this type of material, the sensitivity to micro tips especially at the ceramic metal connection of the vacuum interrupter is limited by the type of potting material.

In a further advantageous embodiment, the insulating housing consist of epoxy or polyurethane material, with a shore hardness bigger than the selected shore hardness of the aforesaid potting material of the compensation layer.

It is important to realize this relation between the hardness of the epoxy housing and the compensation layer.

In a further advantageous embodiment, the insert is a vacuum interrupter or an embedding device.

In that embodiment, the aforesaid use of such a compensation layer is important, because the vacuum interrupter has a ceramic body, which has importantly different thermal expansion parameters then the insulating epoxy housing. For the use in medium voltage, up to 72 kV, such compensation layer is important for the preservation of a high insulation standard.

In a further advantageous embodiment, the compensation layer extends from the complete internal interface of the insert to the complete interface of an upper connection part integrally, which is finally covered by the aforesaid insulating housing.

Internal interface means the mechanical coverage interface between the insert and the upper connection part at one side, and the resulting inner surface of the insulating housing in that region at the other side.

In a further advantageous, but alternative embodiment, the compensation layer covers the interface of the insert and the interface of an upper connection part at least partly, which is finally covered by the aforesaid insulating housing.

According to a method for manufacturing a pole part for a medium or high voltage circuit breaker, with an insert in an insulating housing, and a compensation layer between the insert and the insulating housing, an aspect of the invention is, with a look to the aforesaid object of the invention, that the compensation layer consist of a potting material on epoxy or polyurethane basis, with a shore hardness of 12 to 90 shore A, and is moulded on the surface of the insert, before the insert with deposed compensation layer is moulded into an outer insulating material housing.

In a further advantageous embodiment of the aforesaid method, the insulating housing, moulded on the with a compensation layer covered insert, consist of epoxy material, with a shore hardness bigger than the selected shore hardness of the aforesaid potting material of the compensation layer, wherein the aforesaid hardness relation will be reached at the end of the final moulding step of the insulating housing.

In a further advantageous embodiment, the compensation layer is moulded in such, that it extends from the complete interface of the insert to the complete interface of an upper connection part integrally, which is finally covered by the aforesaid insulating housing.

In a final advantageous embodiment, the compensation layer is moulded in such, that it covers the interface of the insert and the interface of an upper connection part at least partly, which is finally covered by the aforesaid insulating housing.

An embodiment of the invention is shown in the drawing.

The FIGURE shows a longitudinal cut of a pole part 1. An insert 2, here a vacuum interrupter, I covered with the compensation layer 3, made of potting material on epoxy or polyurethane basis, with a shore hardness of 12 to 90 shore A.

In this embodiment, the compensation layer extends from the complete surface of the vacuum interrupter 2 up to the upper connection part 4, respectively.

At the bottom of the vacuum interrupter, a movable contact stem 5 is mechanically coupled to a sliding contact system 6, which is electrically connected to the lower connection part 7. The movable contact stem is mechanically coupled to a pushrod 8, which is coupled to an external drive.

The complete arrangement is moulded into an insulating housing 9.

By that, the aforesaid thin compensation layer 3 of a potting material, based on epoxy or polyurethane material, with a shore hardness similar or less than the actual warm shrinkage tube.

In case of the use of that type of potting material, there is no need of the use of a primer application to the insert part, nor the need of primer to the epoxy polyurethane resin, like already mentioned above. The dielectric strength of the material can be covered and is similar to the actual solution. In case of this type of material, the sensitivity to micro tips especially at the ceramic metal connection of the vacuum interrupter is limited by the type of potting material.

Importantly, the insulating housing, moulded on the with a compensation layer covered insert, consist of epoxy or polyurethane material, with a shore hardness bigger than the selected shore hardness of the aforesaid potting material of the compensation layer, wherein the aforesaid hardness relation will be reached at the end of the final moulding step of the insulating housing.

This relation in the choice of material parameters is important, to result a mechanical compensation.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

NUMBERING

1 Pole part
2 Insert, vacuum interrupter
3 Compensation layer
4 Upper connection part
5 Movable contact stem
6 Sliding contact system
7 Lower connection part
8 Push rod

What is claimed is:

1. A pole part for a medium or high voltage circuit breaker, comprising:
an insulating housing;
a vacuum interrupter; and
a compensation layer,
wherein the vacuum interrupter is in the insulating housing,
wherein the compensation layer is in contact with a surface of the vacuum interrupter,
wherein the compensation layer is between the vacuum interrupter and the insulating housing, and
wherein the compensation layer comprises an epoxy based potting material with a shore hardness of 12 to 90 shore A.

2. The pole part according to claim 1, wherein the compensation layer extends over an interface between the vacuum interrupter and an upper connection part, and
wherein the insulating housing covers the interface.

3. The pole part according to claim 1, wherein the compensation layer covers an upper connection part, and
wherein the upper connection part with the compensation layer is covered by the insulating housing.

4. A low-, medium-, or high voltage switchgear, comprising:
the pole part according to claim 1.

5. The pole part according to claim 1, wherein the compensation layer has been moulded onto the vacuum interrupter.

6. The pole part according to claim 5, wherein the insulating housing has been moulded onto the vacuum interrupter with the compensation layer or the vacuum interrupter with the compensation layer has been moulded into the insulating housing.

7. The pole part according to claim 1, wherein the insulating housing comprises an epoxy or polyurethane material having a shore hardness bigger than the shore hardness of the epoxy based potting material of the compensation layer.

8. A method for manufacturing a pole part for a low-, medium-, or high voltage circuit breaker, comprising:

moulding a compensation layer onto a surface of a vacuum interrupter; and moulding an insulating housing onto the vacuum interrupter with the compensation layer or moulding the vacuum interrupter with the compensation layer into the insulating housing, wherein the compensation layer is between the vacuum interrupter and the insulating housing, and wherein the compensation layer comprises an epoxy based potting material with a shore hardness of 12 to 90 shore A.

9. The method according to claim 8, wherein the insulating housing comprises an epoxy or polyurethane material with a shore hardness bigger than a selected shore hardness of the epoxy based potting material of the compensation layer to provide a hardness relation, and wherein the hardness relation is reached at an end of a final moulding step of the insulating housing.

10. The method according to claim 8, wherein the moulding of the compensation layer extends over an interface between the vacuum interrupter and an upper connection part, and wherein moulding the insulating housing onto the vacuum interrupter with the compensation layer or moulding the vacuum interrupter with the compensation layer into the insulating housing comprises the insulating housing covering the interface.

11. The method according to claim 10, wherein the moulding of the compensation layer covers the upper connection part, and wherein moulding the insulating housing onto the vacuum interrupter with the compensation layer or moulding the vacuum interrupter with the compensation layer into the insulating housing comprises the upper connection part with the compensation layer being covered by the insulating housing.

* * * * *